US006659717B1

(12) United States Patent
Kao

(10) Patent No.: US 6,659,717 B1
(45) Date of Patent: Dec. 9, 2003

(54) FILTER PUMP FOR A POOL

(75) Inventor: Ta-Hai Kao, Tainan (TW)

(73) Assignee: Yuan-Chen Chen, Taoyuan Hsien (TW)

( * ) Notice: Subject to any disclaimer, the term of this patent is extended or adjusted under 35 U.S.C. 154(b) by 0 days.

(21) Appl. No.: 10/192,646

(22) Filed: Jul. 11, 2002

(51) Int. Cl.[7] ..... F04D 29/70
(52) U.S. Cl. ..... 415/121.2; 415/211.2
(58) Field of Search ..... 415/121.2, 148, 415/211.2; 285/328, 330, 397

(56) References Cited

U.S. PATENT DOCUMENTS 3,900,223 A * 8/1975 Schafer et al. ..... 285/4
4,043,917 A * 8/1977 Rowley et al. ..... 210/323.2
4,709,726 A * 12/1987 Fitzgibbons ..... 137/614.04

* cited by examiner

*Primary Examiner*—Ninh H. Nguyen
(74) *Attorney, Agent, or Firm*—Bacon & Thomas, PLLC

(57) ABSTRACT

A filter pump for a pool includes, a motor, a filter, a water intake connecter and a water outlet connecter for combining water pipes. The water intake and outlet connecters are respectively fixed with a connector having male threads outside and a recessed stepped surface inside to make up a receiving space between the connector and the water intake or the water outlet connecter. The water pipe has its end formed with two annular projecting ribs for fitting a rotatable locking cover with female threads therein. After the water pipe is fitted with the water intake or the water outlet connecter, the locking cover is threadably mounted on the connector, letting the water pipe inserted in the receiving space and closely pressed by the locking cover.

4 Claims, 8 Drawing Sheets

FILTER PUMP FOR A POOL

BACKGROUND OF THE INVENTION

This invention relates to a filter pump for a pool, particularly to one easy to be assembled and disassembled, and convenient in use.

It is believed that the best way of relieving heat of summer is to jump into cool water in a pool and make fun in it, and some people prefer to purchase a small-size portable pool together with a filter pump to be used at home rather than go swimming in a public swimming pool because the pool may be far from home and it is not necessarily hygienic to swim therein. The set of filter pump is used for eliminating impurities in the water of a pool by circulatory filtration, and enabling the water in the pool to be used repeatedly.

A conventional filter pump for a pool, as shown in FIG. 1, includes a pump body 10, and a water intake connecter 101 and a water outlet connecter 101' for respectively combining a water pipe 20 to lead water out of and in a pool. The water pipe 20 has one end fitted around with a constriction device 30 made of arc-shaped metallic sheet, as shown in FIG. 3. The arc-shaped metallic sheet has both ends respectively bent to extend outward and form a pair of wings 301, which are made parallel to each other after closely constricted together. The wings 301 respectively have two through holes 302 for bolts 303 to be inserted therethruogh and then screw tightly with nuts 304. After the water pipe 20 is combined respectively with the water intake connecter 101 and the water outlet connecter 101', the bolts 303 and the nuts 304 of the constriction device 30 are tightly screwed together by means of tools (such as a screwdriver and a spanner) so as to let the water pipe 20 firmly connected together with the water intake connecter 101 and the water outlet connecter 101'.

However, the combination of the water intake connecter 101 and the water outlet connecter 101' with the water pipe 20 in the conventional filter pump 10 can hardly be done without tools, resulting in much trouble when the pool and the filter pump 10 have to be assembled for use or disassembled for storing. The pool and the filter pump 10 are not fixed or stationary, often have to be moved, disassembled and assembled, so the conventional filter pump is quite troublesome in using.

SUMMAERY OF THE INVENTION

The objective of the invention is to offer a filter pump for a pool, easy in assembling and disassembling, and convenient in use.

The filter pump includes a valve body provided with a water intake connecter and a water outlet connecter on one side for combining a water pipe respectively. The feature of the invention is that the water intake connecter and the water outlet connecter are respectively fixed with a connecter formed with male threads around the outer surface and a recessed stepped surface in the inner surface to make up a receiving space between the connector and the water intake connecter or the water outlet connecter. The water pipe is provided with two annular projecting ribs around the outer surface of its end, and between the two annular ribs is fitted a rotatable locking cover with female threads. Thus, after the water pipe is combined respectively with the water intake connecter and the water outlet connecter, the locking cover is threadably mounted on the connector to let the water pipe inserted in the receiving space between the connector and the water intake connecter and the water outlet connecter respectively, and the locking cover presses on the outer wall of the water pipe, achieving effect of assembling and disassembling with easiness.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
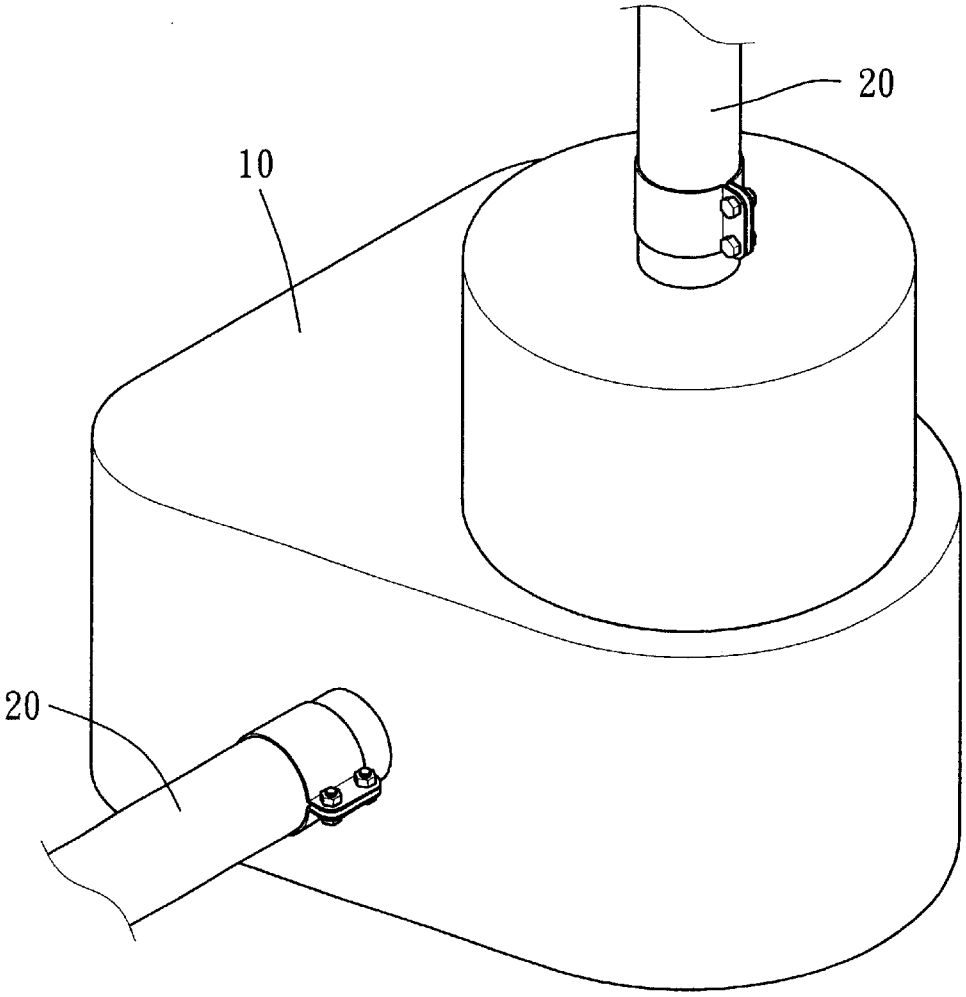
FIG. 1 (PRIOR ART)
FIG. 1 is a perspective view of a conventional filter pump for a pool.
Figure 2:
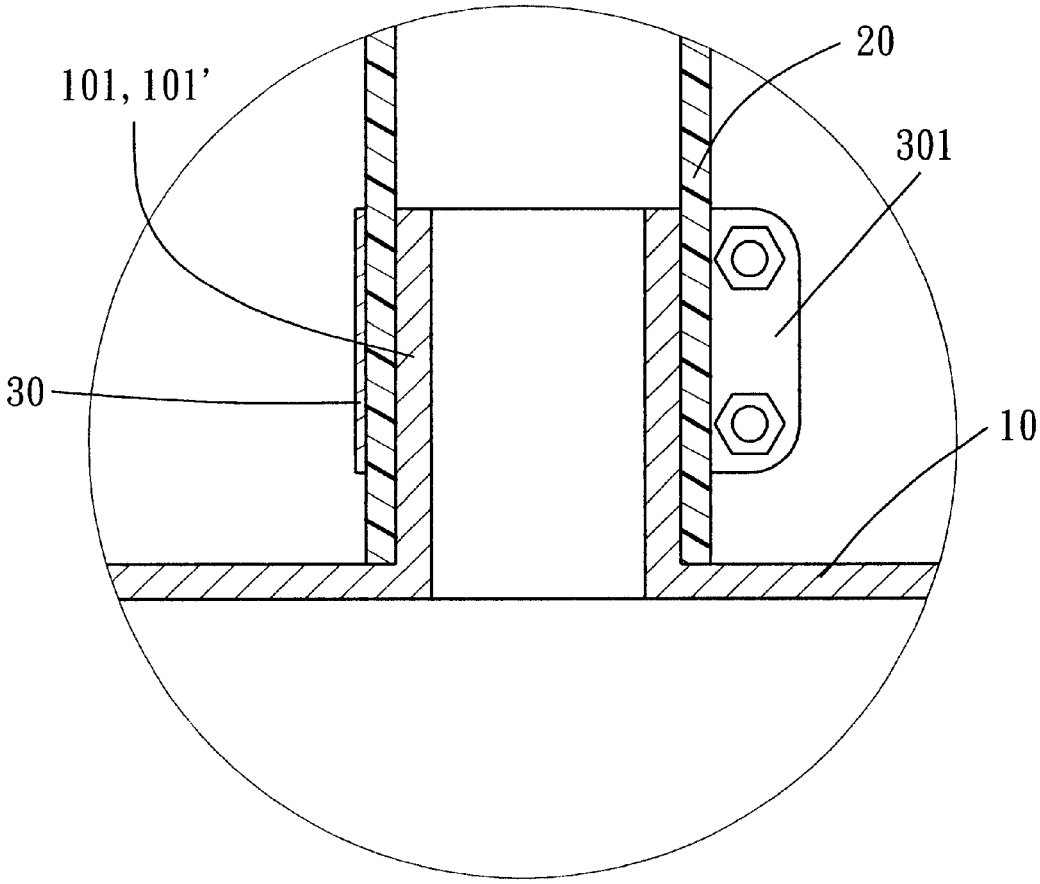
FIG. 2 (PRIOR ART)
FIG. 2 is a cross-sectional view of the conventional filter pump for a pool combined with a water pipe.
Figure 3:
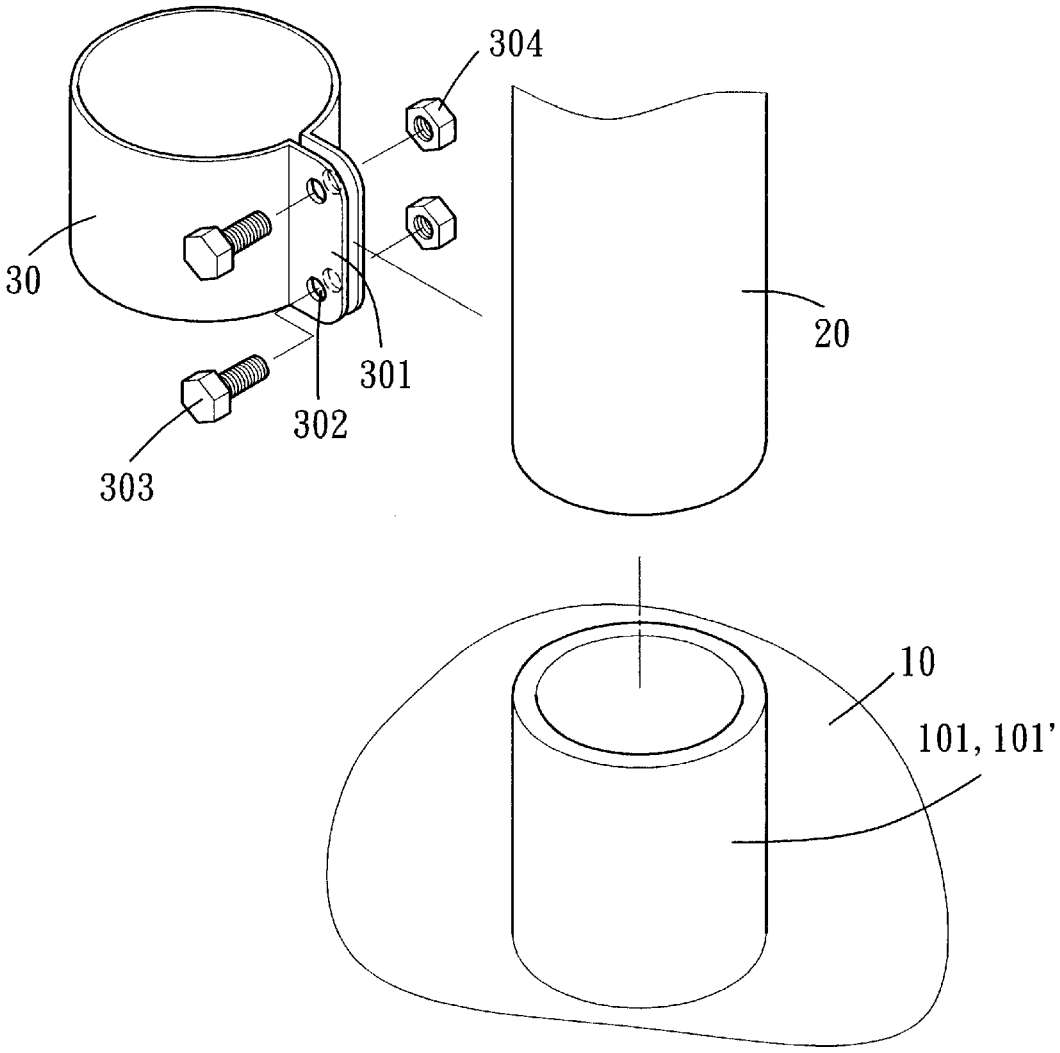
FIG. 3 (PRIOR ART)
FIG. 3 is an exploded perspective view of a constriction device of the conventional filter pump.
Figure 4:
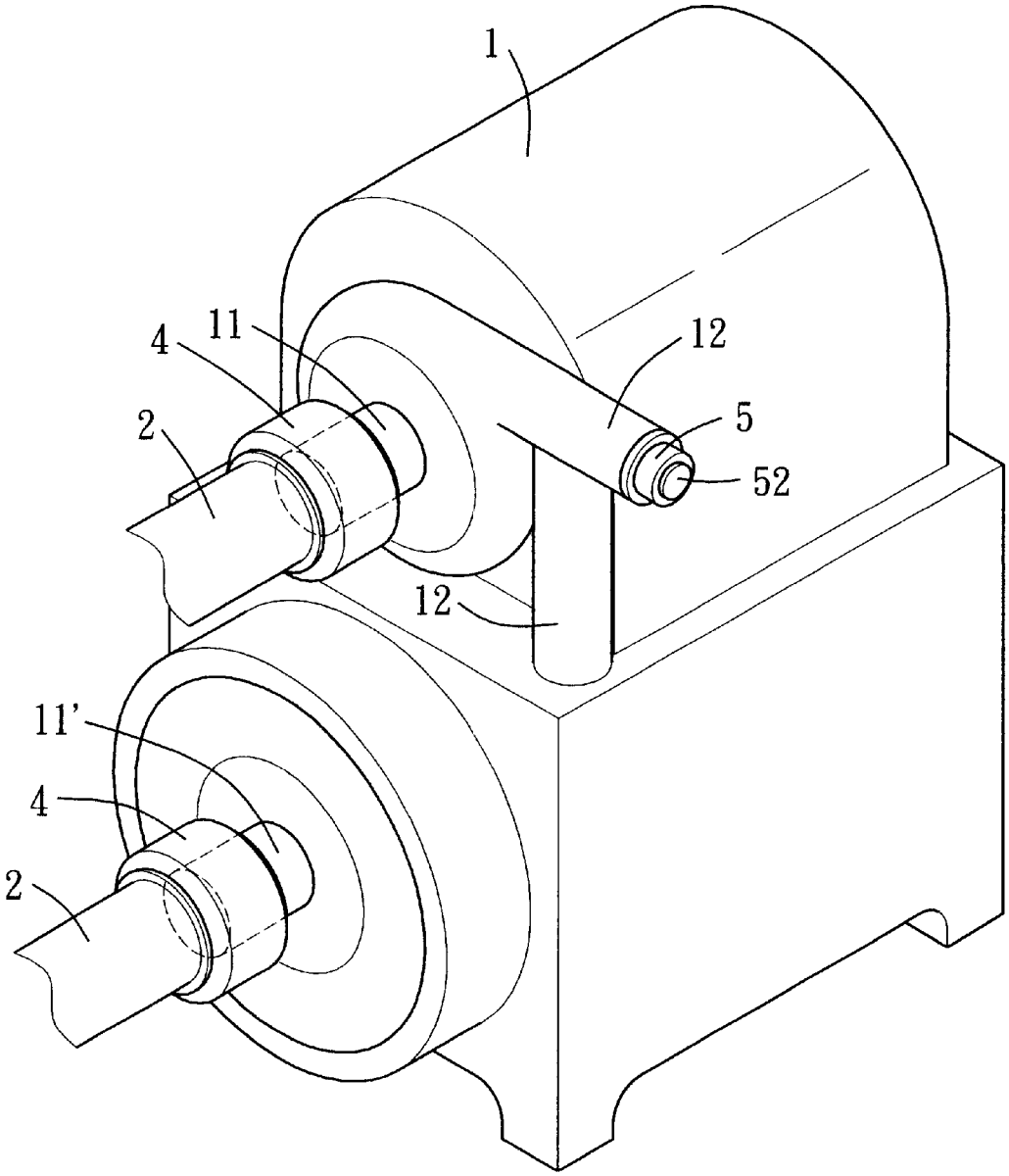
FIG. 4 is a perspective view of a filter pump for a pool in the present invention.

A preferred embodiment of a filter pump 1 in the present invention, as shown in FIG. 4, includes a water-pumping motor and a filter (not shown), and a water intake connecter 11 and a water outlet connecter 11' provided on a same side to be respectively combined with a water pipe 2. The water pipe 2 connected with the water intake connecter 11 guides the water pumped from a pool into the filter pump 1 for filtrating, while the water pipe 2 connected with the water outlet connecter 11' guides the filtrated water to flow back into the pool. The filter pump 1 is further provided with a passage 12 for guiding the water flowing in from the water intake connecter 11 into the filter to be filtrated therein and then guided out through the water outlet connecter 11'.

Figure 5:
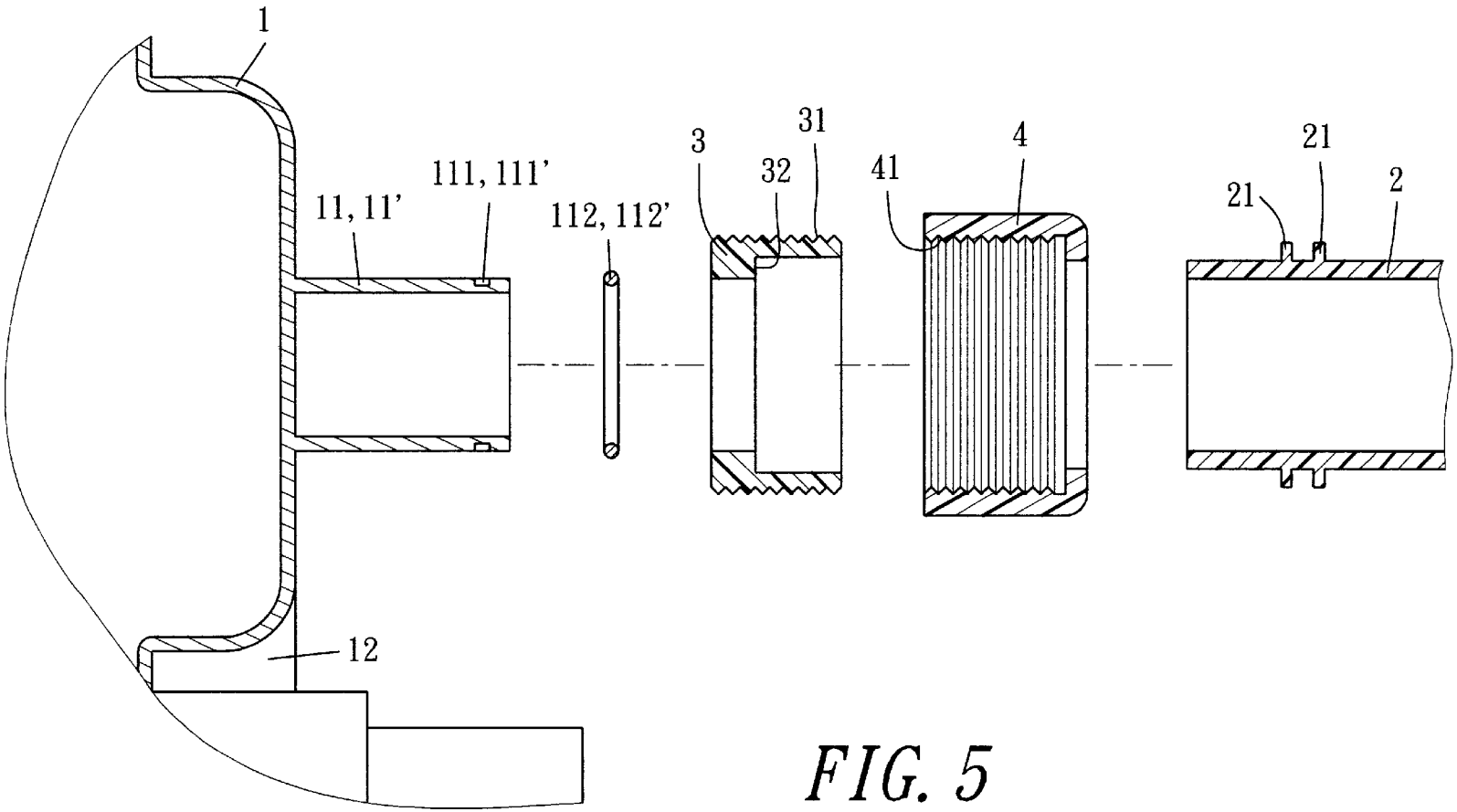
FIG. 5 is an exploded perspective view of the filter pump for a pool in the present invention.

The water intake connecter 11 and the water outlet connecter 11' are respectively connected with connector 3 at an outer end, as shown in FIG. 5. The connector 3 is formed with male threads 31 in an outer surface and a recessed stepped surface 32 on an inner surface to make up a receiving space between the connector 3 and the water intake connecter 11 or the water outlet connecter 11', as shown in FIG. 5. Besides, the water intake connecter 11 and the water outlet connecter 11' are respectively provided with an annular recessed groove 111, 111' around the outer surface near its opening for receiving an annular gasket 112, 112', as shown in FIG. 5.

The water pipe 2 is provided with two annular projecting ribs 21 around its end combined with the water intake connecter 11 or the water outlet connecter 11', and between the two annular projecting ribs 21 is engaged a rotatable locking cover 4 with female threads 41, as shown in FIG. 5.

Figure 6:
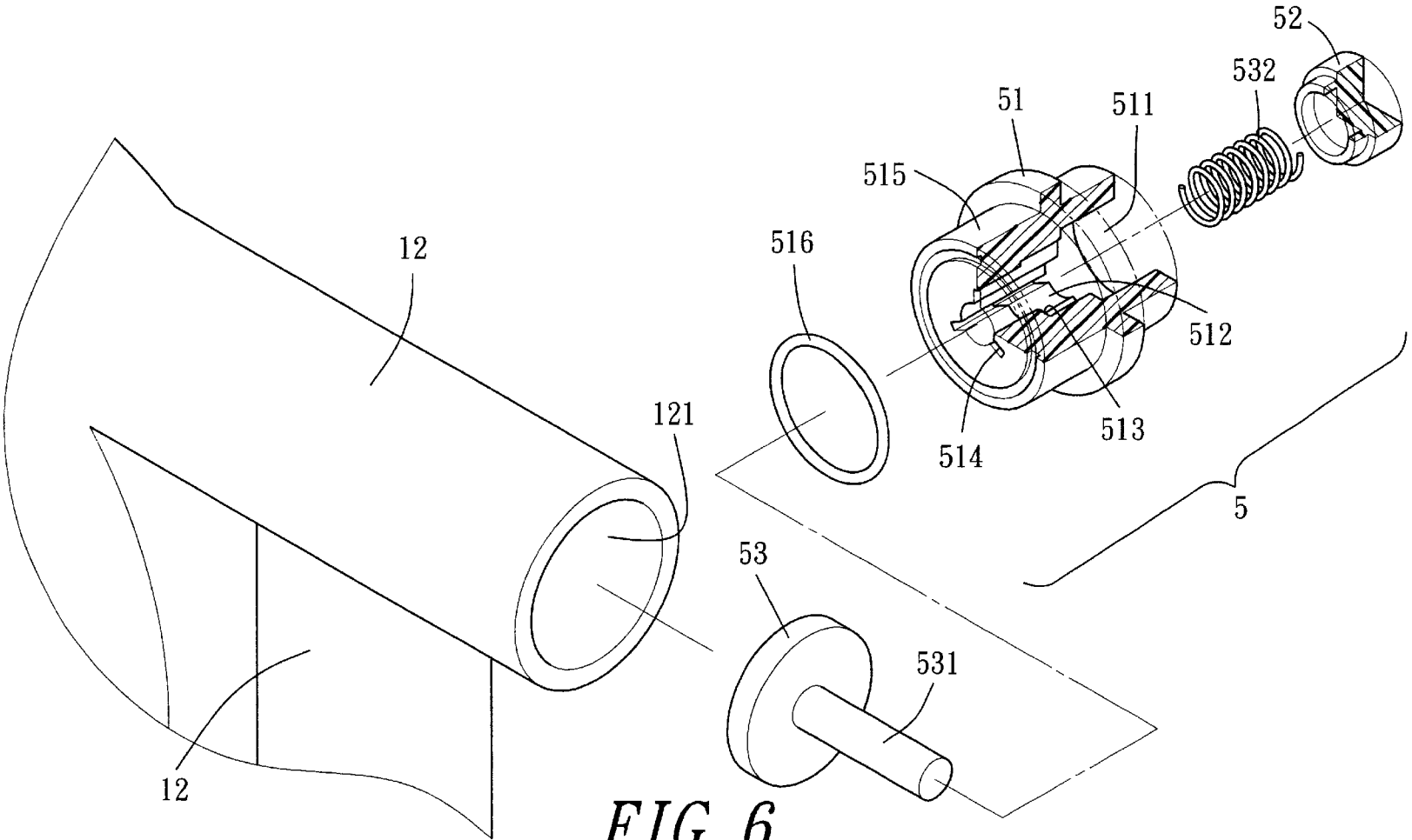
FIG. 6 is an exploded perspective view of an air-exhausting device of the filter pump for a pool in the present invention.

In addition, as shown in FIG. 6, the passage 12 of the filter pump 1 is bored with an air-exhausting opening 121 at a proper location. The air-exhausting opening 121 is fitted with an air-exhausting device 5 having an air-exhausting base 51 firmly secured in the air-exhausting opening 121.

The air-exhausting base 51 is formed at the outer end with a chamber 511 having a through hole 512. The through hole 512 is formed with a recessed stepped surface 513 around the outer periphery of one side facing the chamber 511, and a plurality of axial recessed grooves 514 spaced apart in the inner wall. The air-exhausting base 51 is further provided with an annular stopping surface portion 515 protruding outward at one end facing the passage 12 and closely tucked in the passage 12, with a gasket 516 fitted in an inner end surface of the annular stopping surface portion 515. Then, an air-exhausting button 52 is installed in the chamber 511 of the air-exhausting base 51 and a blocking member 53 corresponding to the air-exhausting button 52 is provided at the other end of the air-exhausting base 51. The blocking member 53 has a support rod 531 extending sidewise outward from an outer side to be fitted around with a spring 532 and having its end fixed with the air-exhausting button 52.

Figure 7:
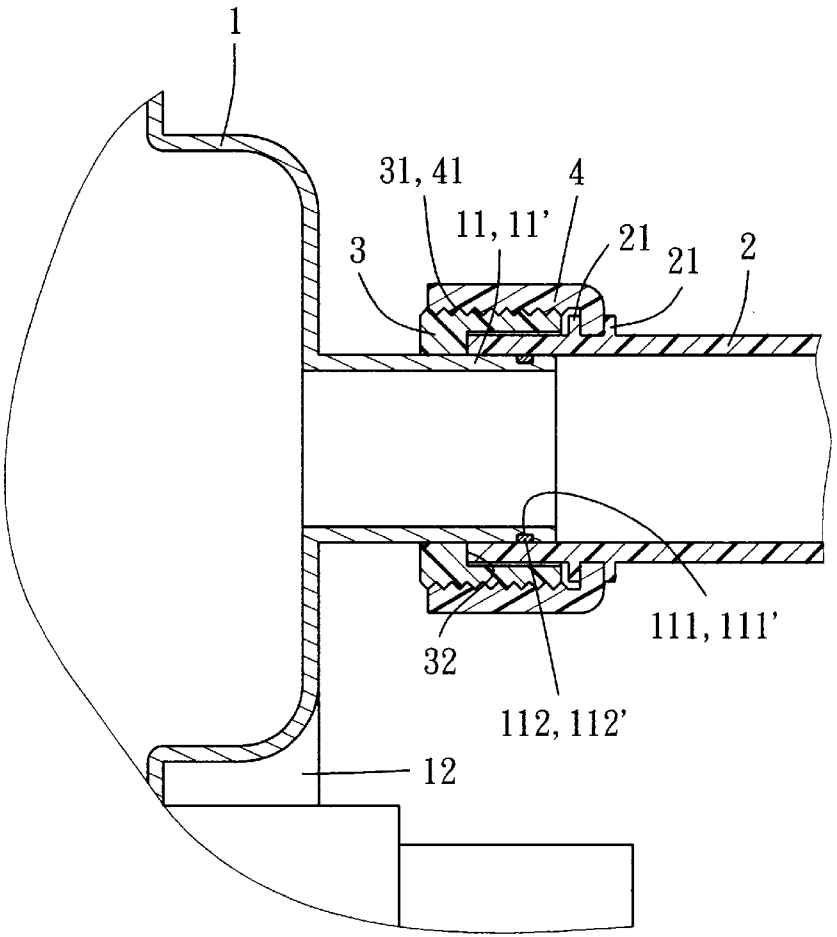
FIG. 7 is a cross-sectional view of the assembled condition of FIG. 5.

In assembling, to combine the water intake connecter 11 and the water outlet connecter 11' with the water pipe 2, as shown in FIG. 7, the end of the water pipe 2 provided with a locking cover 4 is fitted respectively with the water intake connecter 11 and the water outlet connecter 11'. Then, the locking cover 4 is threadably mounted on the connector 3 to let the water pipe 2 inserted in the receiving space between the connector 3 and the water intake connecter 11 and the water outlet connecter 11', and have the locking cover 4 closely pressing on the outer side of the gasket 112 or 112' of the water intake connecter 11 or the water outlet connecter 11', easy to be assembled and disassembled without tools, and able to be sealed closely.

Figure 8:
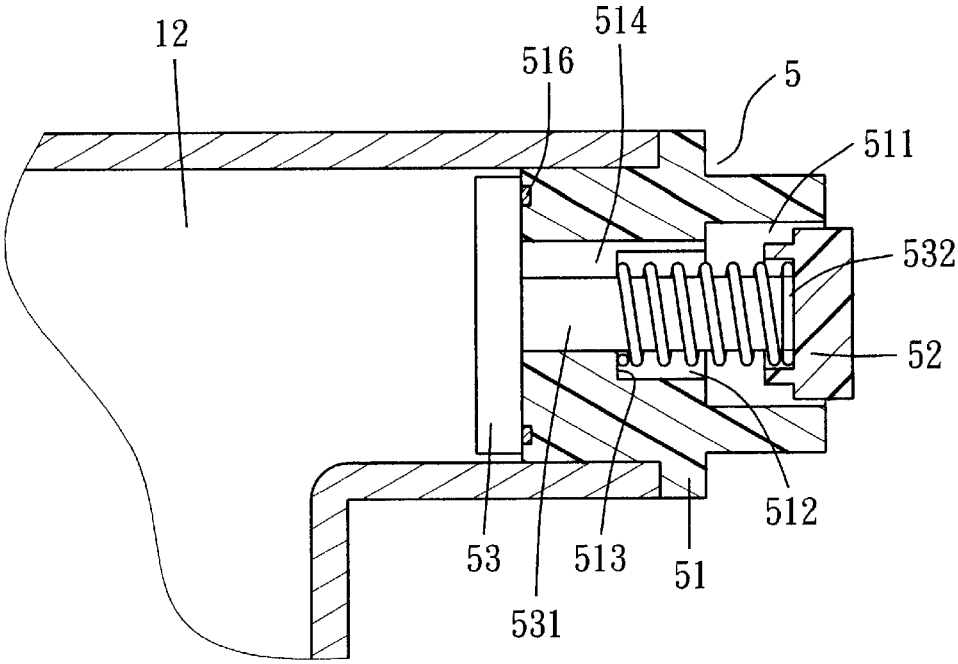
FIG. 8 is a cross-sectional view of the air-exhausting device in the present invention.

To assemble the air-exhausting device 5, as shown in FIG. 8, the support rod 531 of the blocking member 53 is first inserted through the through hole 512 of the air-exhausting base 51 and then fitted around with the spring 532 and fixed with the air-exhausting button 52 to finish assembling the air-exhausting device 5. Subsequently, the annular stopping surface portion 515 of the air-exhausting device 5 is closely tucked in the air-exhausting opening 121 of the passage 12. Thus, the spring 532 has one end pushing against the air-exhausting button 52 and the other end resting on the stepped surface 513 of the air-exhausting base 51 and force the blocking member 53 with its resilient force to press on the gasket 516 on the front end of the annular stopping surface portion 515 so as to seal up the air-exhausting opening 121.

Figure 9:
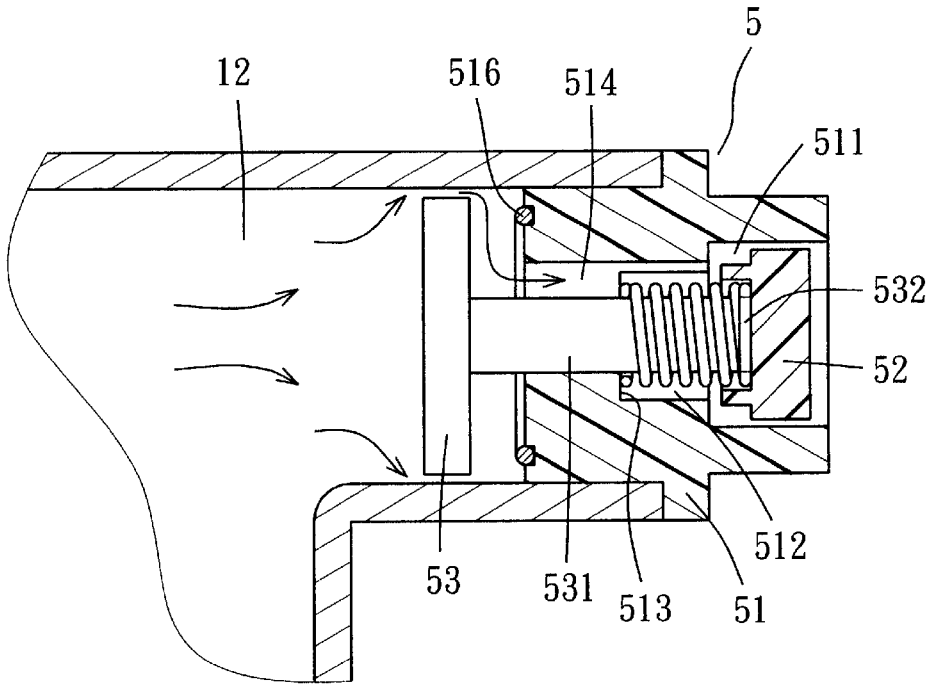
FIG. 9 is a cross-sectional view of the air-exhausting device in a used condition in the present invention.

In using, as shown in FIG. 9, the moment the filter pump is started, a user can press inward the air-exhausting button 52 to let the spring 532 contracted, and synchronously the blocking member 53 separates from the gasket 516 to make the air-exhausting device 5 communicable. At this time, the filter pump 1 keeps on rotating, and air in the air-exhausting device 5 and in the water pipe 2 will flow out of the filter pump 1 through the axial recessed grooves 514 of the air-exhausting device 5, preventing the air from flowing in the interior of the filter pump 1. And after the air is completely exhausted, release the air-exhausting button 52, and the spring 532 will automatically recover its original position and the air-exhausting opening 121 will be sealed up again, as shown in FIG. 8.

While the preferred embodiment of the invention has been described above, it will be recognized and understood that various modifications may be made therein and the appended claims are intended to cover all such modifications that may fall within the spirit and scope of the invention.

I claim:

1. A filter pump for a pool comprising a water-pumping motor, a water intake connecter and a water outlet connecter, said water-pumping motor pumping water in a pool into a filter body for filtrating and filtrated water sent back into said pool, said water intake connecter and said outlet connecter provided on one side of said filter pump, said intake connecter and said outlet connecter respectively combined with a water pipe, said water intake connecter and said water outlet connecter respectively fixed with a connector, said connector formed with male threads around an outer surface and a stepped surface in an inner surface, between said connector and said water intake connecter or said water outlet connecter formed a receiving space, said water pipe provided with two annular projecting ribs around an inner end, a rotatable locking cover fitted between two said projecting ribs, said locking cover formed with female threads, said water pipe fitted with said water intake connecter or said water outlet connecter, said locking cover threadably mounted around said connector, said water pipe inserted in said receiving space between said connector and said water intake connecter or said water outlet connecter, said locking cover closely pressing on the outer wall of said water pipe.

2. The filter pump for a pool as claimed in claim 1, wherein said water intake connecter and said water outlet connecter are respectively provided with an annular recessed groove around an outer end near the opening for receiving an annular gasket, and said locking cover tightly presses on an outer surface of said annular gasket.

3. The filter pump for a pool as claimed in claim 1, wherein said filter pump is provided with a passage for guiding the water coming from said water intake connecter into a filter to be filtrated therein, and said passage has an air-exhausting opening located at a proper location and provided fixedly with an air-exhausting device therein, said air-exhausting device consisting of an air-exhausting base fixed in said air exhausting opening, said air-exhausting base formed with a chamber in the outer end, said chamber bored with a through hole, said through hole provided with a recessed stepped surface at one end facing said chamber, said through hole having its inner wall formed with a plurality of axial recessed grooves, said air-exhausting base provided with an annular stopping surface portion formed in an inner side and facing said passage, said annular stopping surface portion extending outward and tucked in said passage, an air-exhausting button fitted in said chamber of said air-exhausting base, a blocking member provided at the other end of said air-exhausting base and corresponding to said air-exhausting button said blocking member formed with a support rod protruding outward sidewise from an outer side, said support rod fitted around with a spring after inserted through said through hole of said air-exhausting base, said support rod having its end secured on said air-exhausting button, said blocking member forced by the resilience of said spring to press against said annular stopping surface portion to make said air-exhausting opening sealed closely.

4. The filter pump for a pool as claimed in claim 3, wherein said annular stopping surface portion has its end fitted with a gasket, and said blocking member presses on said gasket.

* * * * *